US007639225B2

(12) United States Patent
Wang et al.

(10) Patent No.: US 7,639,225 B2
(45) Date of Patent: Dec. 29, 2009

(54) METHOD FOR ELIMINATING DEFICIENT IMAGE ON LIQUID CRYSTAL DISPLAY

(75) Inventors: Wei-Chih Wang, Dali (TW); Yi-Te Liu, Bade (TW)

(73) Assignee: Novatek Microelectronics Corp., Hsinchu (TW)

( * ) Notice: Subject to any disclaimer, the term of this patent is extended or adjusted under 35 U.S.C. 154(b) by 717 days.

(21) Appl. No.: 11/302,028

(22) Filed: Dec. 12, 2005

(65) Prior Publication Data

US 2007/0080919 A1 Apr. 12, 2007

(30) Foreign Application Priority Data

Oct. 6, 2005 (TW) ..... 94134931 A

(51) Int. Cl.
*G09G 3/36* (2006.01)

(52) U.S. Cl. ..... 345/94; 345/88; 345/211

(58) Field of Classification Search ..... 345/94, 345/84, 211

See application file for complete search history.

(56) References Cited

U.S. PATENT DOCUMENTS 6,621,489 B2 * 9/2003 Yanagisawa et al. ..... 345/211
2006/0044240 A1 * 3/2006 Takizawa et al. ..... 345/88

* cited by examiner

*Primary Examiner*—Richard Hjerpe
*Assistant Examiner*—Leonid Shapiro
(74) *Attorney, Agent, or Firm*—J.C. Patents

(57) ABSTRACT

A method for eliminating deficient image on a liquid crystal display (LCD) is provided. The method is used for eliminating the deficient image generated during the shutdown period in a normally white LCD. The method comprises the following steps. First, when a power indication signal changes from a first state to a second state, a black frame is displayed in a first period of time. At the end of the first period, a white frame is displayed in a second period of time. At the end of the second period, the supply of a negative scan voltage is stopped and a white frame is displayed in a third period of time. At the end of the third period, the power is turned off.

16 Claims, 6 Drawing Sheets

METHOD FOR ELIMINATING DEFICIENT IMAGE ON LIQUID CRYSTAL DISPLAY

CROSS-REFERENCE TO RELATED APPLICATION

This application claims the priority benefit of Taiwan application serial no. 94134931, filed on Oct. 6, 2005. All disclosure of the Taiwan application is incorporated herein by reference.

BACKGROUND OF THE INVENTION

1. Field of the Invention

The present invention relates to a method of controlling a liquid crystal display device. More particularly, the present invention relates to a method for eliminating deficient image on a liquid crystal display device.

2. Description of the Related Art

Liquid crystal display devices are widely adopted to display information in recent years. With the rapid advance in semiconductor fabrication technologies, liquid crystal display devices having the advantages of low power consumption, streamlined body, high resolution, high color saturation level and long lifetime are widely used in many types of electronic products such as the liquid crystal display screens of notebook computers or desktop computers as well as liquid crystal display (LCD) televisions.

FIG. 1 is a circuit diagram of a conventional liquid crystal display panel. As shown in FIG. 1, the display panel circuit includes a plurality of data lines 100, a plurality of gate lines 102, a plurality of thin film transistors 104, a plurality of storage capacitor 106 and a plurality of pixel capacitors 108. One of the terminals of each storage capacitor 106 is coupled to the gate line 102 and the other terminal of the storage capacitor 106 is coupled to the source of the thin film transistor 104. One of the terminals of each pixel capacitor 108 is coupled to the source of the thin film transistor 104 and the other terminal of the pixel capacitor 108 is coupled to a common potential 110, which generally is a predetermined direct current or alternating current potential.

To display an image, the gate driver will provide a positive scan voltage such as +12.5V to the selected gate line 102 so that the transistor is being on. Then, the storage capacitor 106 and the pixel capacitor 108 will receive the gray-scale potential from the data line 100 so that the gray-scale potential received by the pixel capacitor 108 and the common potential 110 generate a gray-scale voltage difference that biased rotation in the liquid crystal. On the other hand, the gate driver will provide a negative scan voltage such as −12.5V to all the unselected gate lines 102 so that the transistors are cut off. Because the pixel capacitor 108 is small, the storage capacitor 106 is used to maintain the gray-scale potential until the next gray-scale potential input arrives.

FIG. 2 is a diagram showing the timing sequence of various signals during the shutdown period of a conventional liquid crystal display device. As shown in FIGS. 1 and 2, the liquid crystal display panel is assumed to be a normally white LCD. When a power-off instruction is transmitted, the power indication signal will change from a state of high logic potential to a state of low logic potential. Then, the source driver will output a black frame such as 00H. After the passage of at least a vertical synchronous timing period (that is, at least a frame period), the source driver will output a white frame such as 3FH. The white frame is used to discharge the voltage between the terminals of each pixel capacitor until the potential difference reaches a near zero value. Finally, the positive scan voltage control signal VGH and the negative scan voltage control signal VGL are simultaneously disabled to shut down the positive scan voltage source and the negative scan voltage source.

In the foregoing shutdown sequence, the presence of a parasitic capacitor between the source and the gate of the thin film transistor leads to a coupling between the scan voltage and the storage capacitor 106. Hence, the voltage in the storage capacitor 106 will fluctuate when the positive scan voltage source and the negative scan voltage source are simultaneously shut down. The voltage fluctuation often leads to a biased rotation in the liquid crystal molecules and results in the production of a deficient image. Furthermore, with the simultaneous shut down of the negative scan voltage source and the positive scan voltage source, the voltage variation on the gate line 102 will also affect the voltage difference between the terminals of the pixel capacitor. Consequently, there will be an inversion of the liquid crystal molecules resulting in the generation of a deficient image. The appearance of a deficient image on a high-quality display product such as a liquid crystal display device is often not acceptable.

SUMMARY OF THE INVENTION

Accordingly, at least one objective of the present invention is to provide a method for eliminating deficient image in a liquid crystal display device, capable of removing the deficient image on a normally white liquid crystal display device during shutdown period.

At least another objective of the present invention is to provide a method for eliminating deficient image in a liquid crystal display device, capable of removing the deficient image on a normally black liquid crystal display device during shutdown period.

To achieve these and other advantages and in accordance with the purpose of the invention, as embodied and broadly described herein, the invention provides a method of eliminating deficient image in a liquid crystal display device. The method includes the following steps. First, when a power indication signal changes from a first state to a second state, a black frame is displayed in a first period of time. At the end of the first period, a white frame is displayed in a second period of time. At the end of the second period, the supply of a negative scan voltage is stopped and a white frame is displayed in a third period of time. Finally, at the end of the third period, the power is turned off.

According to the foregoing method of eliminating deficient image on the liquid crystal display in one preferred embodiment of the present invention, the first period, the second period and the third period are a time period of an integral times of a vertical synchronous time period.

The present invention also provides an alternative method of eliminating deficient image in a liquid crystal display device. The method is used for eliminating the deficient image on a normally black liquid crystal display device during shutdown period. The method includes the following steps. First, when a power indication signal changes from a first state to a second state, a white frame is displayed in a first period of time. At the end of the first period, a black frame is displayed in a second period of time. At the end of the second period, the supply of a negative scan voltage is stopped and a black frame is displayed in a third period of time. Finally, at the end of the third period, the power is turned off.

According to the foregoing method of eliminating deficient image in the liquid crystal display in one preferred embodiment of the present invention, the first period, the second period and the third period are a time period of an integral times of a vertical synchronous time period.

In the present invention, a new shutdown sequence for a liquid crystal display device is introduced. The new shutdown sequence is able to eliminate the deficient image generated during the period when a normally white or a normally black liquid crystal display device is being shut down.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
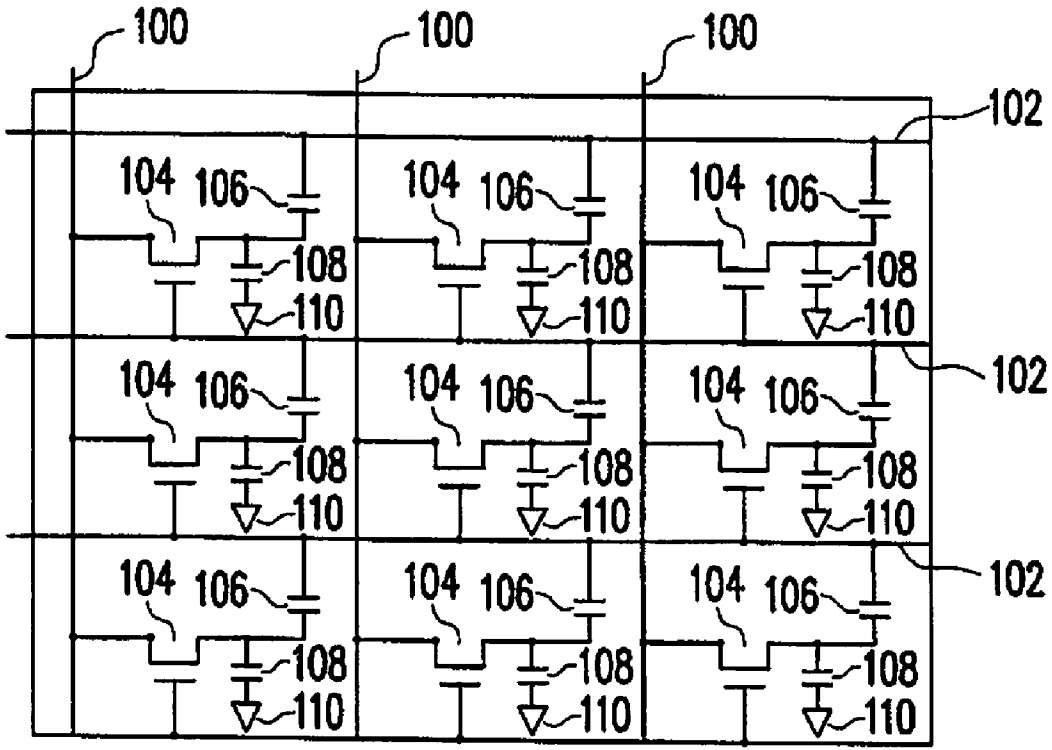
FIG. 1 (PRIOR ART)
FIG. 1 is a circuit diagram of a conventional liquid crystal display panel.
Figure 2:
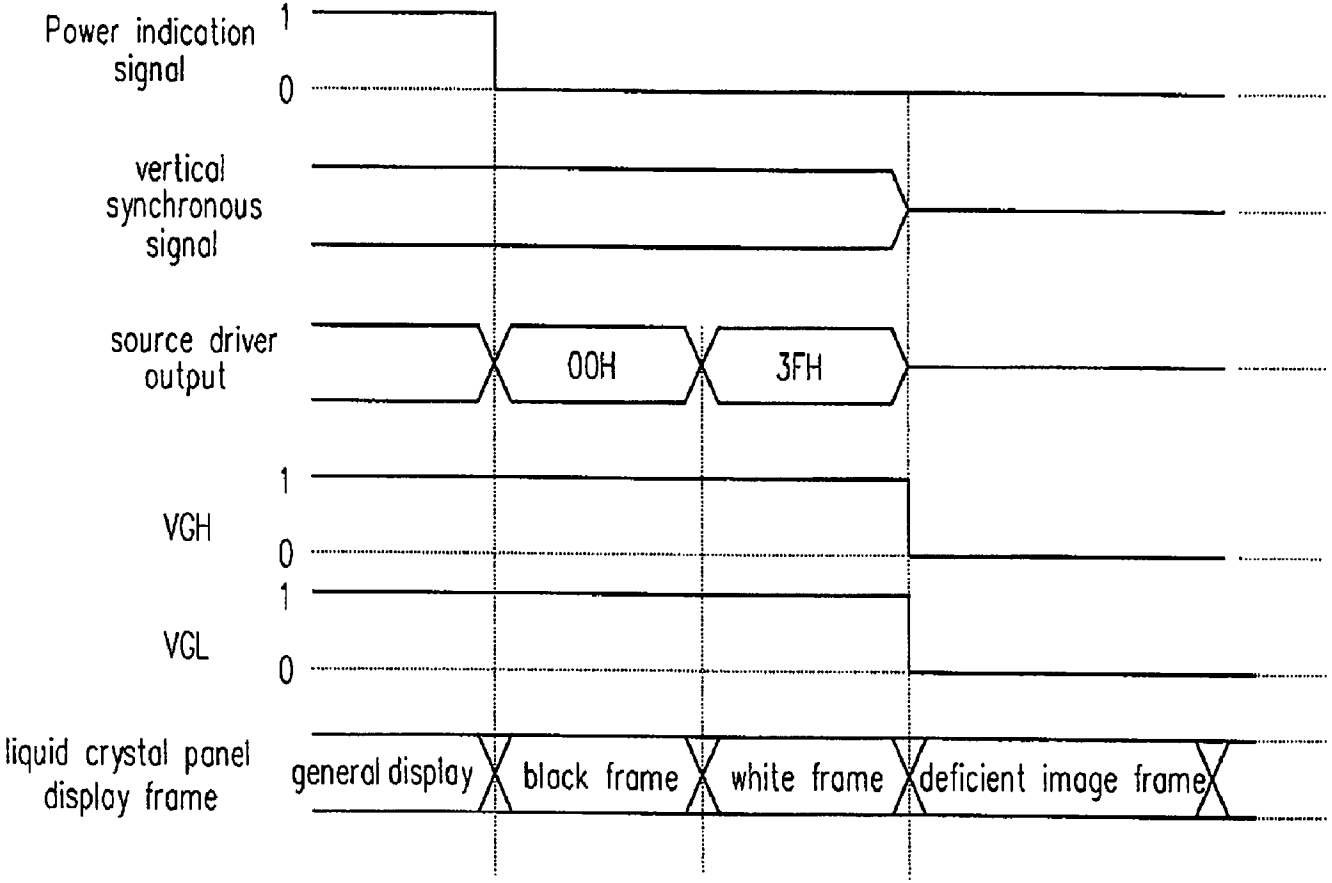
FIG. 2 (PRIOR ART)
FIG. 2 is a diagram showing the timing sequence of various signals during the shutdown period of a conventional liquid crystal display device.

Reference will now be made in detail to the present preferred embodiments of the invention, examples of which are illustrated in the accompanying drawings. Wherever possible, the same reference numbers are used in the drawings and the description to refer to the same or like parts.

To eliminate deficient image resulting from a conventional shutdown sequence, the present invention provides a method for removing the deficient image on a liquid crystal display. The method includes changing the shutdown sequence and using the new shutdown sequence to replace the conventional one. The following is a more detailed description of the steps according to one embodiment of the present invention.

Figure 3:
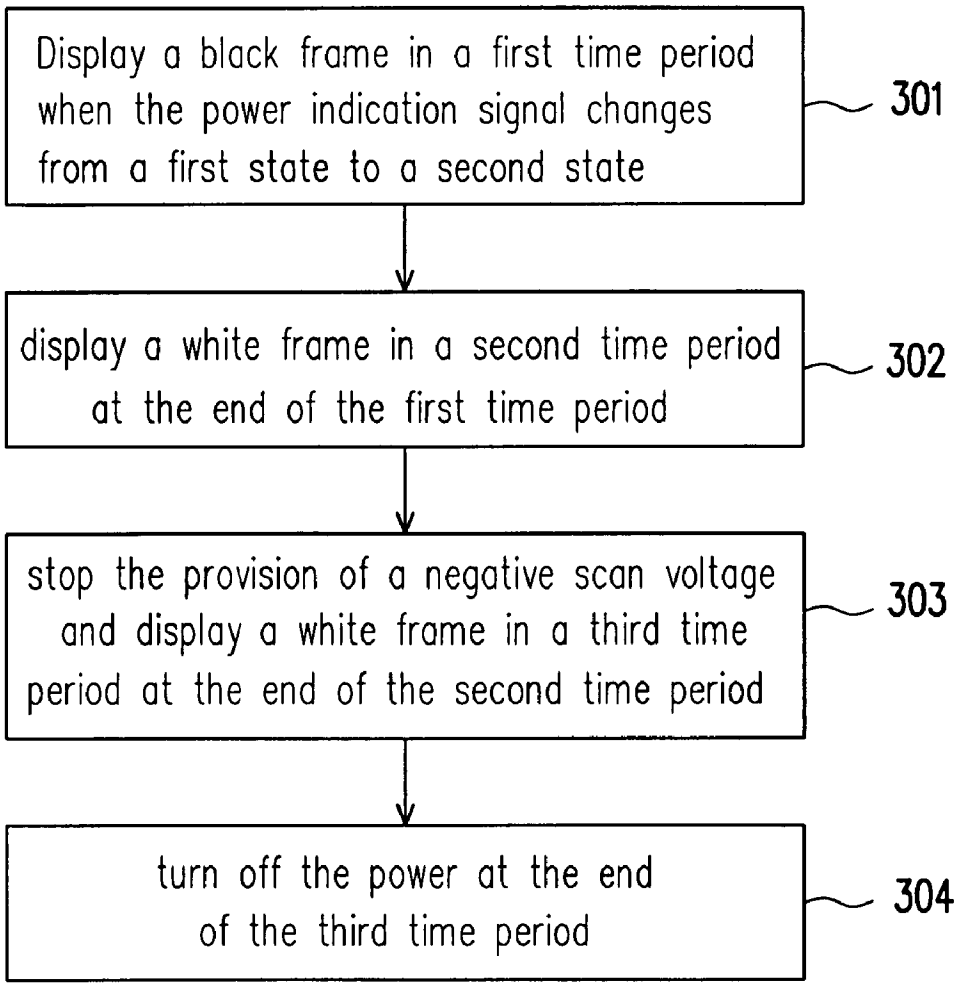
FIG. 3 is a flow diagram showing the steps for eliminating the deficient image on a liquid crystal display device according to one embodiment of the present invention.
Figure 4:
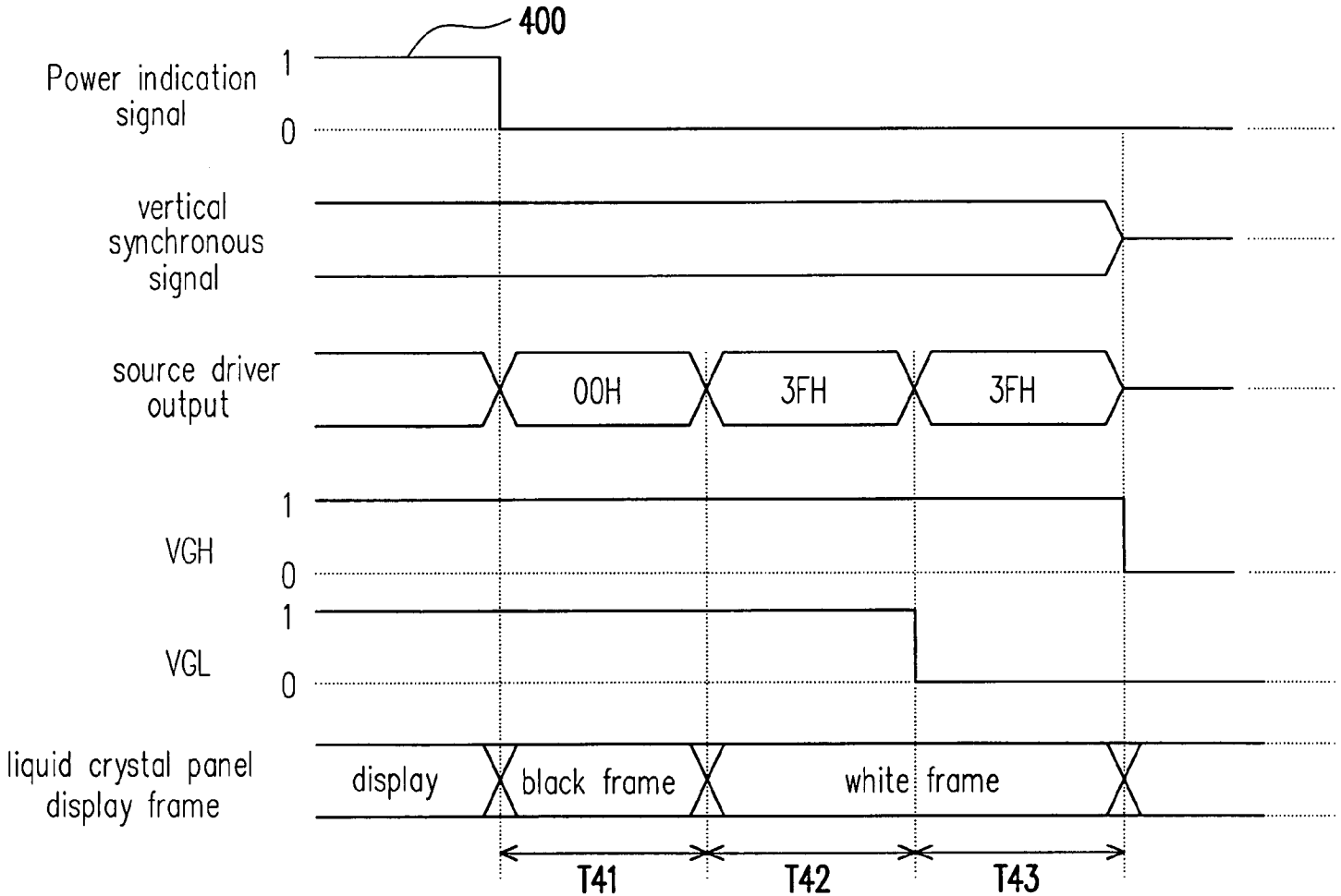
FIG. 4 is a diagram showing the timing sequence of various signals in the method of removing deficient image from the liquid crystal display device according to one embodiment of the present invention.

FIG. 3 is a flow diagram showing the steps for eliminating the deficient image in a liquid crystal display device according to one embodiment of the present invention. FIG. 4 is a diagram showing the timing sequence of various signals in the method of removing the deficient image from the liquid crystal display device according to one embodiment of the present invention. As shown in FIGS. 3 and 4, the present embodiment is used for eliminating the deficient image generated during the period when a normally white liquid crystal display device or liquid crystal display panel is being shut down.

First, when a power indication signal 400 changes from a first state (a logic high potential) to a second state (a logic low potential), this indicates a command for turning off the display device or the display panel has been issued. Then, a black frame (in step 301) is displayed in a first time period T41. The first time period T41 can be a vertical synchronous (VSYNC) period, also called "a frame period". The first time period may be a multiple of the vertical synchronous time period or even 1.5 times of the vertical synchronous period. Because a user may initiate the shut down command while the frame is displaying, the power indication signal will change from the first state (a logic high potential) to a second state (a logic low potential) when the frame scanning is not yet completed. Therefore, a black gray scale value can be directly applied to the un-scanned frame so that a black frame is displayed.

At the end of the first period T41, a white frame (step 302) is displayed in a second time period T42. The display panel is a normally white liquid crystal display panel whose characteristic is that a white pixel is displayed whenever the potential between the terminals of the pixel capacitor 108 is smaller than or equal to a white preset potential (typically, the white preset potential is about 0.2V but may differ according to the type of the panel used). Hence, a white pixel is displayed whenever the data driver outputs a byte of data with a gray scale such as 3FH so that the potential between the two terminals of a pixel capacitor 108 is driven down to a value smaller than or equal to the white preset potential. Similarly, the second period T42 can be implemented as long as it has a period greater than or equal to a single vertical synchronous time period, for example, a vertical synchronous time period, a multiple of the vertical synchronous time period or 1.3 of a vertical synchronous time period.

At the end of the second period T42, the supply of a negative scan voltage is stopped and a white frame is displayed in a third period T43 (step 303). At the end of the second period T42, the negative scan voltage control signal VGL changes from a high logic potential to a low logic potential to shut down the negative scan voltage source. At this time, the liquid crystal display panel will operate in such a way that the gate driver will apply a positive scan voltage such as +12.5V to a selected gate line after one of the gate lines has been selected by the gate driver. With the shutdown of the negative scan voltage source, all the other non-selected gate lines are maintained at a ground potential. Then, after initiating the third period T43, the white frame is input. The voltage between the two terminals of all pixel capacitors in the panel is discharged to a potential close to zero. Because the negative scan voltage source is shut down at the end of the second period T42, the capacitor terminal that couples with the gate line will not encounter any voltage fluctuation problem. Similarly, the third period T43 can be implemented as long as it has a period larger than or equal to a single vertical synchronous time period, for example, a vertical synchronous time period, a multiple of the vertical synchronous time period or 1.3 of a vertical synchronous time period.

At the end of the third period T43, the power to the positive scan voltage source is shut down (step 304). In other words, the positive scan voltage control signal VGH is changed from a high logic potential to a low logic potential to shut down the positive scan voltage source. Then, the power source is turned off. Because there are no more changes in the potential between the two ends of the pixel capacitors, biased rotation in the liquid crystal molecules will no longer occur and neither will any deficient image be generated.

Figure 5:
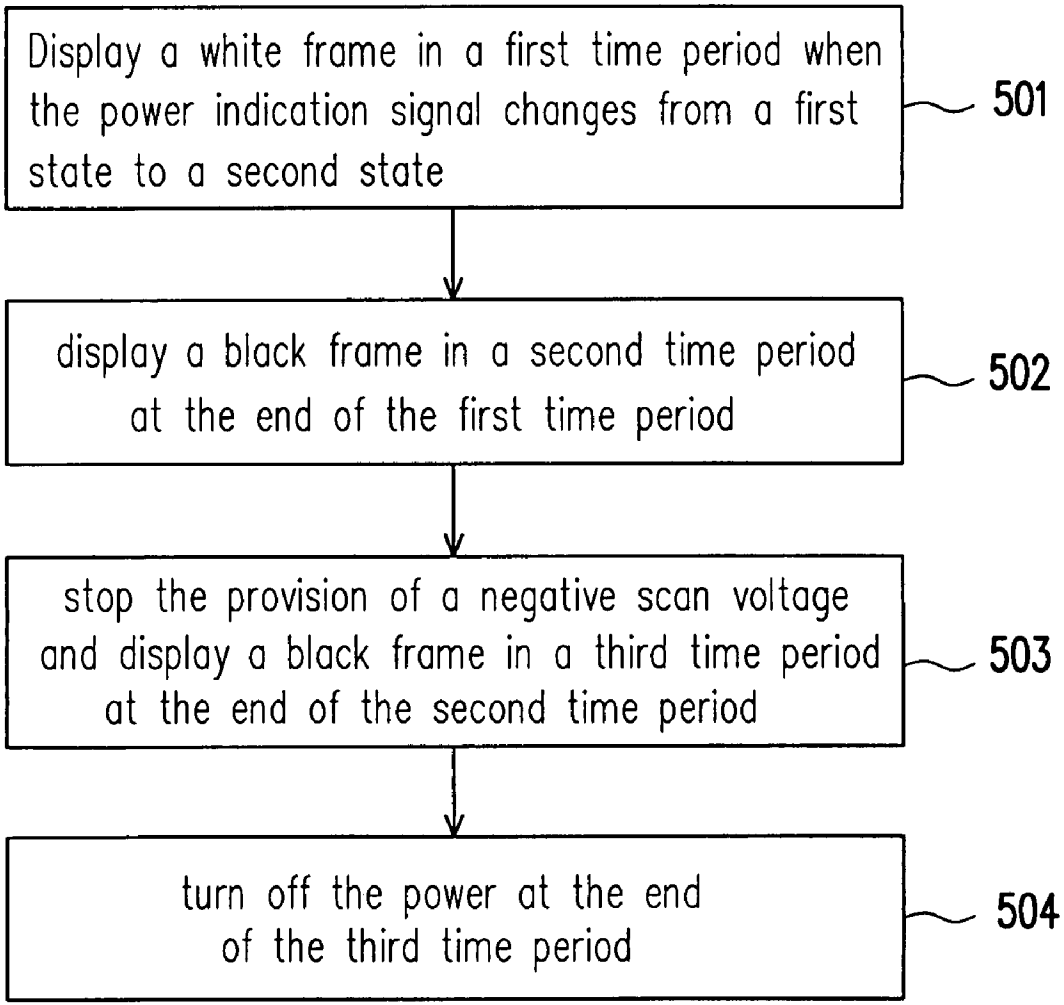
FIG. 5 is a flow diagram showing the steps for eliminating the deficient image on a liquid crystal display device according to another embodiment of the present invention.
Figure 6:
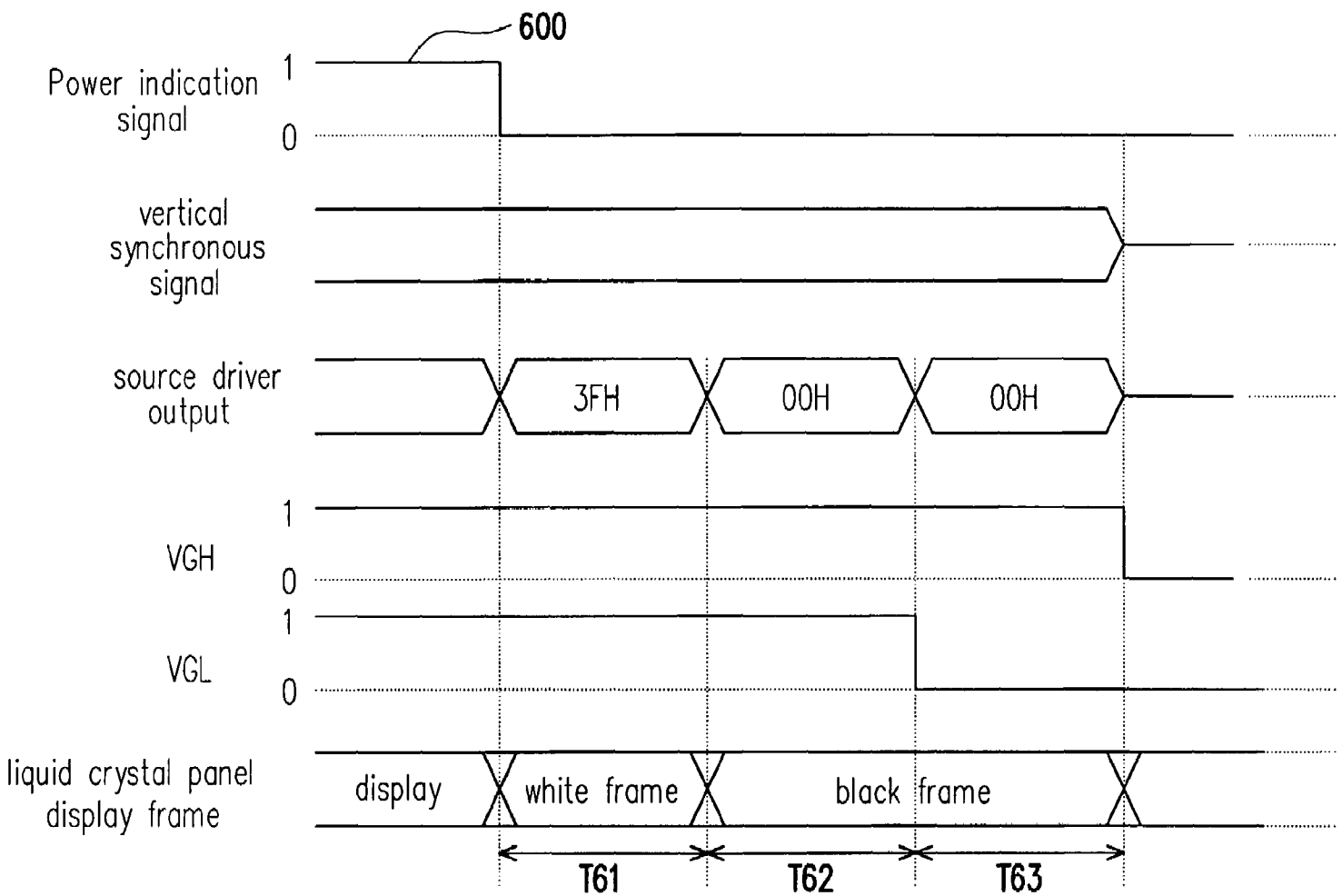
FIG. 6 is a diagram showing the timing sequence of various signals in the method of removing deficient image from the liquid crystal display device according to another embodiment of the present invention.

The aforementioned embodiment is applied to a normally white liquid crystal display device or liquid crystal display panel. However, the embodiment of the present invention can also be applied to a normally black liquid crystal display device or a liquid crystal display panel. FIG. 5 is a flow diagram showing the steps for eliminating the deficient image in a liquid crystal display device according to another embodiment of the present invention. FIG. 6 is a diagram showing the timing sequence of various signals in the method of removing deficient images from the liquid crystal display device according to another embodiment of the present invention. As shown in FIGS. 5 and 6, the embodiment in the present invention can be applied to a normally black liquid crystal display device or a normally black liquid crystal display panel for eliminating deficient image when the device or the panel is being shut down.

First, when a power indication signal 600 changes from a first state (a logic high potential) to a second state (a logic low potential), this indicates a command for turning off the display device or the display panel has been issued. Then, a white frame (in step 501) is displayed in a first time period T61. The first time period T61 in the embodiment of the present invention can be implemented as long as it has a period larger than or equal to a single vertical synchronous time period, for example, a vertical synchronous time period, a multiple of the vertical synchronous time period or even 1.5 times of the vertical synchronous time period.

At the end of the first period T61, a black frame is displayed in a second time period T62 (step 502). The display panel is a normally black liquid crystal display panel whose characteristic is that a black pixel is displayed whenever the potential between the terminals of the pixel capacitor 108 is smaller than or equal to a black preset potential (typically, the black preset potential is about 0.2V but may differ according to the type of the panel used). Hence, a black pixel is displayed whenever the data driver outputs a byte of data with a gray scale such as 00H so that the potential between the two terminals of a pixel capacitor 108 is driven down to a value smaller than or equal to the black preset potential. Similarly, the second period T62 can be implemented as long as it has a period greater than or equal to a single vertical synchronous time period, for example, a vertical synchronous time period, a multiple of the vertical synchronous time period or 1.5 of a vertical synchronous time period.

At the end of the second period T62, the supply of a negative scan voltage is stopped and a black frame is displayed in a third period T63 (step 503). At the end of the second period T62, the negative scan voltage control signal VGL changes from a high logic potential to a low logic potential to shut down the negative scan voltage source. At this time, the gate lines not selected by the gate driver are maintained at a ground potential. Then, after initiating the third period T63, the black frame is input. The voltage between the two terminals of all pixel capacitors in the panel is discharged to a potential close to zero. Because the negative scan voltage source is shut down at the end of the second period T62, the capacitor terminal that couples with the gate line will not encounter any voltage fluctuation problem. Similarly, the third period T63 can be implemented as long as it has a period larger than or equal to a single vertical synchronous time period, for example, a vertical synchronous time period, a multiple of the vertical synchronous time period or 1.5 of a vertical synchronous time period.

At the end of the third period T63, the power to the positive scan voltage source is shut down (step 504). In other words, the positive scan voltage control signal VGH is changed from a high logic potential to a low logic potential to shut down the positive scan voltage source. Then, the power source is turned off. Because there are no more changes in the potential between the two ends of the pixel capacitors, biased rotation in the liquid crystal molecules will no longer occur and neither will any deficient image be generated.

In summary, the present invention establishes a new shutdown sequence for a liquid crystal display device that the negative scan voltage source is shut down and at least a discharged frame is displayed before the device is turned off. Therefore, the new shutdown sequence is able to eliminate the deficient image generated during the period when a normally white liquid crystal display device or a normally black liquid crystal display device is being shut down.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for eliminating a deficient image in a liquid crystal display device, capable of removing the deficient image on a normally white liquid crystal display device during a shutdown period, comprising the steps of:

displaying a black frame in a first time period when a power indication signal changes from a first state to a second state;

displaying a white frame in a second time period at the end of the first time period;

stopping providing a negative scan voltage at the end of the second time period; and turning off a positive scan voltage after the negative scan voltage is turned off.

2. The method of claim 1, further comprising turning off the power source of the normally white liquid crystal device after the positive scan voltage is turned off.

3. The method of claim 1, further comprising displaying the white frame in a third time period.

4. The method of claim 1, wherein the step of displaying the white frame includes lowering the potential at two terminals of all pixel capacitors to a value smaller than or equal to a first preset potential.

5. The method of claim 1, wherein the step of displaying the black frame includes raising the potential at two terminals of all pixel capacitors to a value larger than or equal to a second preset potential.

6. The method of claim 1, wherein the first state is a logic high potential and the second state is a logic low potential.

7. The method of claim 3, wherein the first time period, the second time period and the third time period are greater than or equal to a vertical synchronous time period.

8. The method of claim 3, wherein the first time period, the second time period and the third time period are a time period of an integral times of a vertical synchronous time period.

9. A method for eliminating a deficient image in a liquid crystal display device, capable of removing the deficient image on a normally black liquid crystal display device during a shutdown period, comprising the steps of:

displaying a white frame in a first time period when a power indication signal changes from a first state to a second state;

displaying a black frame in a second time period at the end of the first time period;

stopping providing a negative scan voltage at the end of the second time period; and turning off a positive scan voltage after the negative scan voltage is turned off.

10. The method of claim 9, further comprising turning off the power source of the normally black liquid crystal device after the positive scan voltage is turned off.

11. The method of claim 9, further comprising displaying the black frame in a third time period.

12. The method of claim 9, wherein the step of displaying the black frame includes lowering the potential at two terminals of all pixel capacitors to a value smaller than or equal to a first preset potential.

13. The method of claim 9, wherein the step of displaying the white frame includes raising the potential at two terminals of all pixel capacitors to a value larger than or equal to a second preset potential.

14. The method of claim 9, wherein the first state is a logic high potential and the second state is a logic low potential.

15. The method of claim 11, wherein the first time period, the second time period and the third time period are greater than or equal to a vertical synchronous time period.

16. The method of claim 11, wherein the first time period, the second time period and the third time period are a time period of an integral times of a vertical synchronous time period.

* * * * *